United States Patent [19]

Patnaude

[11] 4,179,080

[45] Dec. 18, 1979

[54] DOLLY

[76] Inventor: Henry A. Patnaude, 831 Los Molinos Way, Sacramento, Calif. 95825

[21] Appl. No.: 895,800

[22] Filed: Apr. 12, 1978

[51] Int. Cl.[2] ..... B65H 17/46; B65H 75/40

[52] U.S. Cl. ..... 242/86.52

[58] Field of Search ..... 242/86.52, 86.5 R, 58; 280/47.24–47.27, 47.34, 63, 62, 96

[56] References Cited

U.S. PATENT DOCUMENTS

| | | | |
|---|---|---|---|
| 543,823 | 7/1895 | Allis et al. | 242/86.5 R X |
| 2,355,441 | 8/1944 | Jacob | 242/86.5 R |
| 2,576,587 | 11/1951 | Furbush | 242/96 |
| 3,091,414 | 5/1963 | Patnaude | 280/62 X |
| 3,379,392 | 4/1968 | Garnett | 242/86.5 R |
| 3,460,774 | 8/1969 | Martin | 242/58 |

*Primary Examiner*—John M. Jillions

*Attorney, Agent, or Firm*—Blair, Brown & Kreten

[57] ABSTRACT

Disclosed herein is an improved dolly for transporting tarpaulins or vinyl covers that are to be deployed or retracted over areas to be protected. The improvements consist of providing the cover deployment area with a protective shroud, an improved framework and suspension system, an improved steering arrangement, and a supplemental nesting area for tarpaulin supporting shafts that have been already deployed or are to be deployed.

5 Claims, 5 Drawing Figures

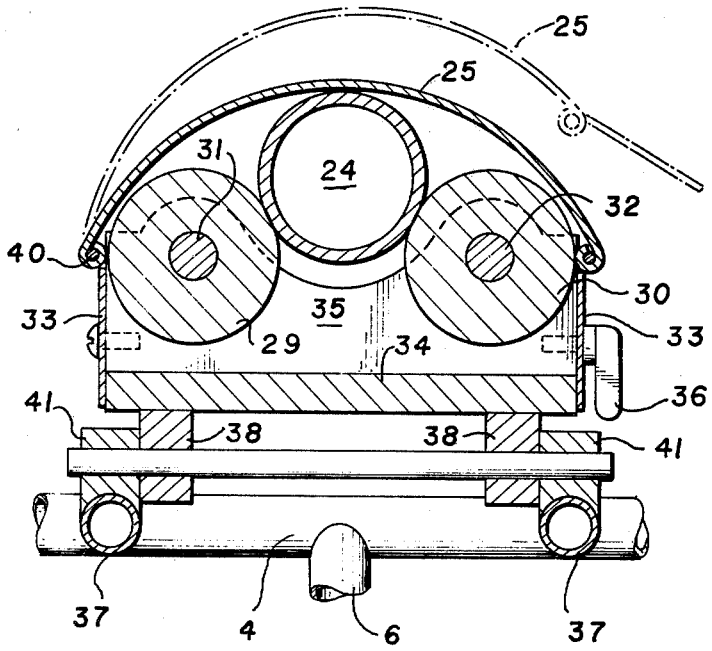
FIG. 4
FIG. 5
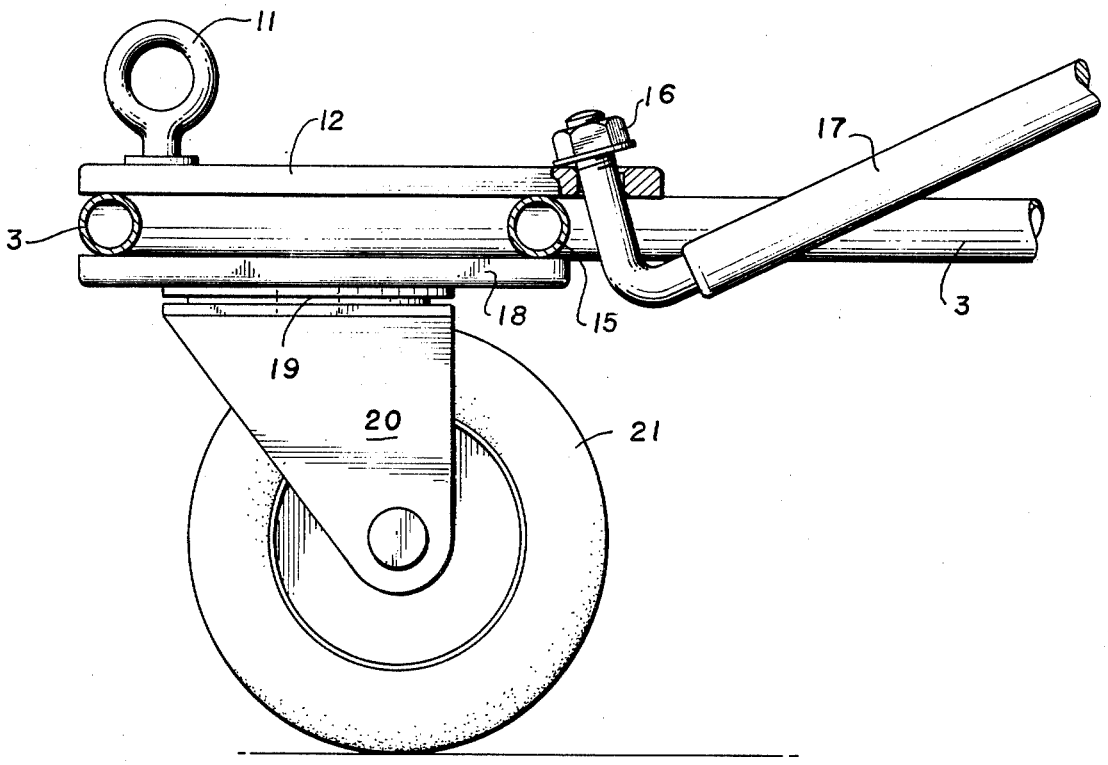

DOLLY

BACKGROUND OF THE INVENTION

Field of the Invention

This invention relates generally to improvements in my previous U.S. Pat. No. 3,091,414 entitled Pool Cover Dolly in which there is taught an apparatus for deploying and retracting tarps of various dimensions. The improvements to be delineated hereinbelow and specified substantially as hereinabove define over this reference in a plurality of ways. For example, the improved framework and suspension results in a machine which is not structurally limited in its size and therefore is useable in very large operations, for example deployment over an olympic size pool rather than a small residential type pool. In addition however the framework lends itself to being towed by motorized vehicles so that the associated weight of the vinyl cover or tarpaulin does not become a limiting factor in the size of the vinyl cover or tarp that can be handled. In addition however the framework is of simple enough construction that it is not cumbersome to be handled manually. The protective shroud mentioned above and specified hereinafter provides a safety guard for people utilizing this dolly.

A new handle structure is also disclosed which lends itself to the greater flexibility of this improved dolly and an ensuing discussion will make evident the contributions that the instant application provides over the prior art.

Accordingly, it is an object of this invention to provide an improved dolly which can deploy and retract covers of various dimensions either manually or by a machine. Further it is an object of this invention to provide a dolly which can store unused cover carrying poles and their associated vinyl covers or tarps until needed.

A third object contemplates providing an improved handle.

A further object provides an improved suspension.

A further object contemplates as an object of this invention a safety guard for greater safety when using the apparatus according to the present invention.

It is to be noted that the word "tarpaulin" is not to be construed as to eliminate covers of other materials, i.e., vinyl, plastics, etc. This device is intended for use in removing and replacing covers on swimming pools as well as athletic fields.

These and other objects will be made manifest when considering the following detailed drawings and specification.

BRIEF DESCRIPTION OF THE DRAWINGS

FIG. 4 is a sectional view taken along lines 4—4 of FIG. 2; and

FIG. 5 is a sectional view along lines 5—5 of FIG. 2.

DESCRIPTION OF THE PREFERRED EMBODIMENT

Figure 1:
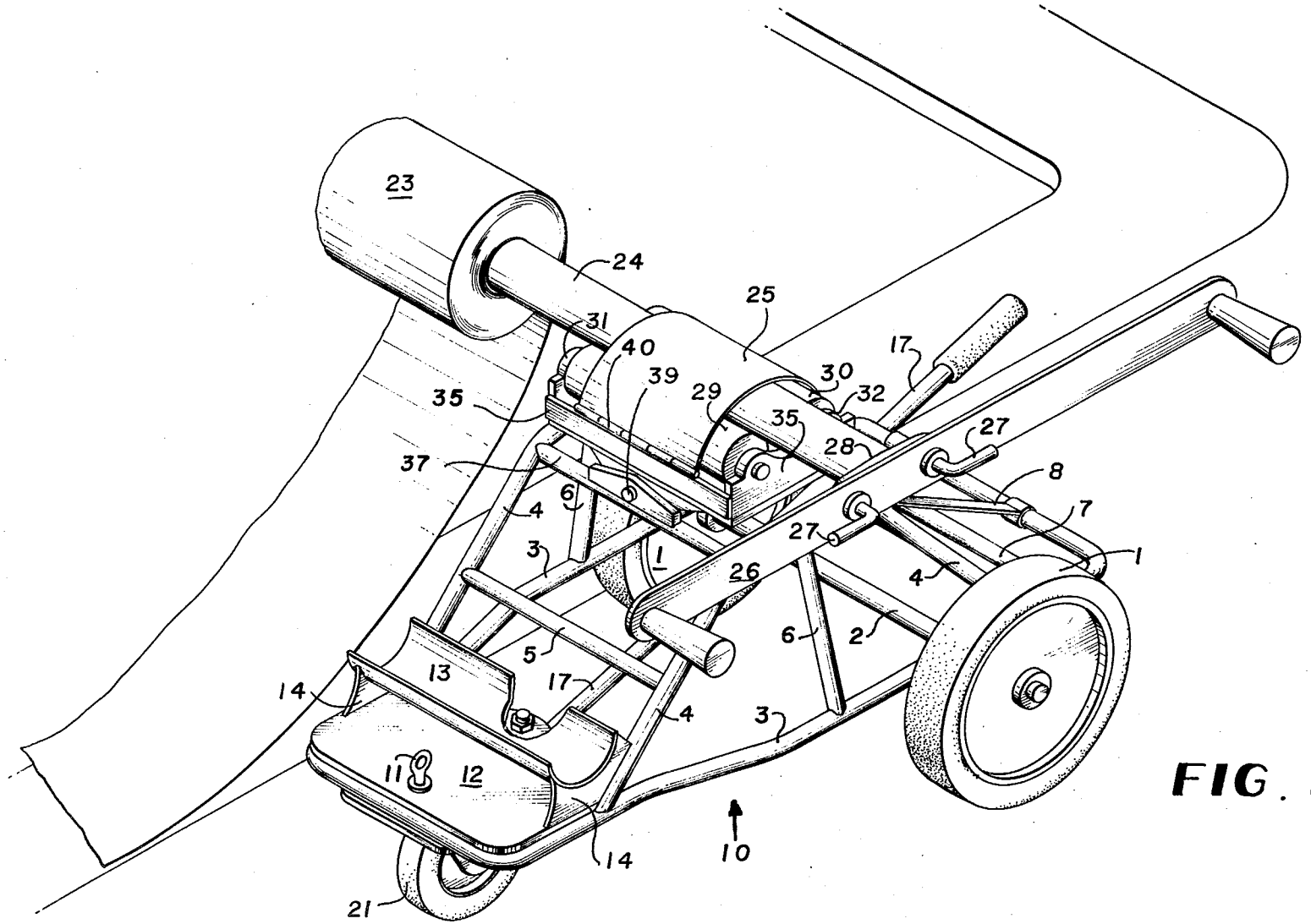
FIG. 1 is a perspective view of the apparatus according to the present invention.

Referring to the drawings now wherein like reference numerals refer to like parts throughout the several drawings reference numeral 10 generally denotes the dolly according to the present invention.

Figure 2:
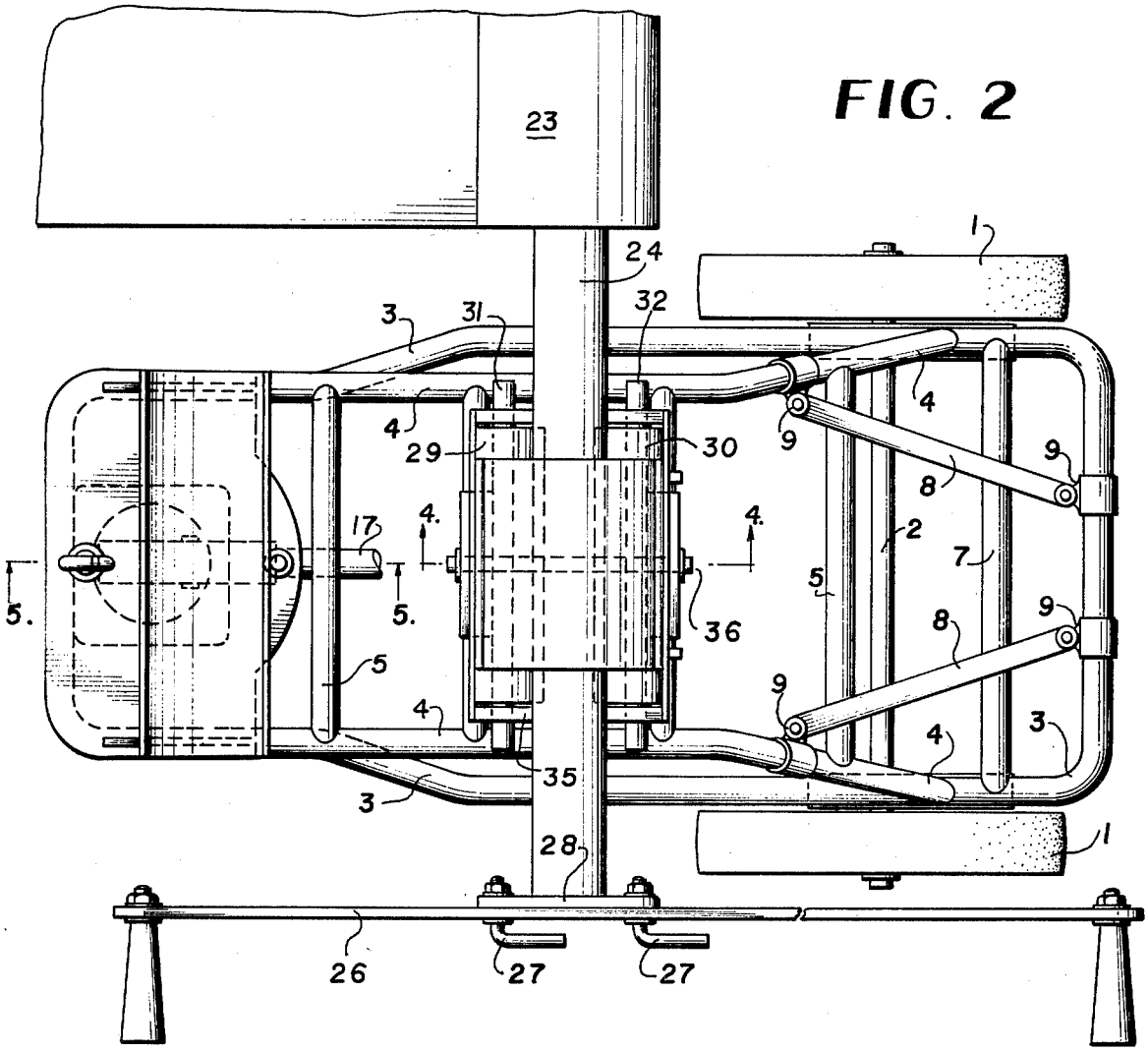
FIG. 2 is a top plan view thereof.
Figure 3:
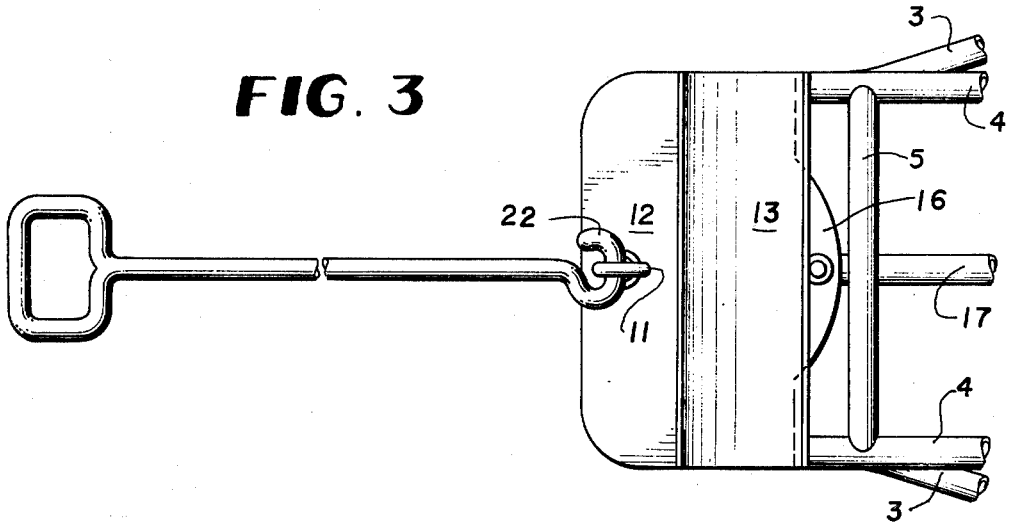
FIG. 3 is a top plan view of a portion of the front of the dolly according to the present invention.

This dolly and its associated structure may generally be regarded as defining a lower frame member 3 having a substantially rectangular configuration which tapers inwardly in the forward nose portion, and this frame 3 supports an axle 2 which carries a pair of wheels 1. The lower portion of this framework 3 communicates with the upper portion by means of inverted U-shaped tubes 4 which have a planar horizontal top portion which supports and carries the vinyl or tarpaulin deploying device to be discussed hereinafter. Vertical support members 6 are disposed substantially medially along inverted U-shaped member 4 at its horizontal linear upper extent and the inverted U-shaped members 4 fastened to frame 3 are further laterally supported by cross braces 5 one of which is disposed in the front of the carriage or dolly and one is disposed at the rear substantially midway between the horizontal portion of U-shaped frame member 4 and the lower frame member 3. An upper portion of the U-shaped frame member 4 is provided with an additional cross bar 37 which serves to provide additional rigidification to support the vinyl cover or tarpaulin. These cross bars 37 similar to cross bars 5 are disposed at the front and rear of the dolly and disposed thereabove are block members 41 having a transverse supporting rod 39 medially disposed between the two U-shaped bars 4 as best seen in FIG. 4 to provide further support. Nested on top of the transverse bar 39 are block elements 38 which support a housing in which the cover carrying pole or shaft 24 rides on rollers. The housing is best seen in FIG. 4 and can be defined as comprising a base plate member 34 which rests on block members 38 having side wall members 33 in the front and back and end wall members 35 in which the end wall members 35 are provided with holes to support and carry axles 31 and 32 upon which rollers 29 and 30 respectively are carried. These rollers 29 and 30 serve to carry the cover carrying pole 24 and allow this pole to rotate freely. The safety shield not only includes this shroud previously discussed for the rollers but also a curvilinear top portion 25 hingedly supported at 40 on one wall 33 and the other wall opposite thereof serves to provide a latching for the arcuate cover 25 through latch handle hook 36. It is therefore apparent that the cover 23 disposed on cover carrying pole 24 can be freely deployed or retracted in response to either rotation of the handles 26 or by some other means to be discussed hereinafter. The cover carrying pole 24 terminates in a flanged end 28 as best seen in FIG. 2 and lock handles 27 fasten the flange 28 to the handle 26 if a manual winding and reeling is to be performed. In the absence of a manual operation, these handles can be easily removed by rotating these lock members 27.

The lower frame member 3 is also provided with a rearwardly disposed cross brace 7 as best seen in FIG. 2 and the backmost portion of frame 3 connects with the U-shaped supports 4 by means of resilient tie bars 8 which are connected therebetween by means of a sleeve and pivot 9. The purpose of this sleeve and pivot is to cooperate with the thin rod members 8 to serve as a torsional damping device for strengthening for loading upon the cover carrying pole 24 as sometimes occurs when there is a bind in the cover.

The front portion of the lower frame member 3 has been described as tapering somewhat but still maintaining a rectangular or square front configuration as best seen in FIGS. 1 and 2 and this structure can now be described. Referring to FIGS. 1, 2, 3 and 5 there is shown a front nose portion of the frame 3 having a transversely disposed support bar 15 which communicates with opposed sides of the frame 3. Below this frame network there is disposed a wheel 21 connected to a plate 18 which is fastened to the framework 3 and 15 by means of a swivel joint 19 and downwardly extending strut 20 which overrides the two faces of wheel 21. The supporting strut 20 is capable of rotating so as to be able to change direction of the dolly as is necessary. Above the framework 3 and 15 is an upper plate 12 on which an eye bolt 11 has been disposed so as to accommodate a handle 22 suitably fashioned to accept a motorized towing vehicle. In the absence thereof however a handle having substantially L-shaped configuration 17 is connected to the top rear portion of plate 12 through bolt 16 to provide pushing of the dolly.

Somewhat rearwardly of the front portion and braced between frame members 3 and 4 is a U-shaped trough 13 supported on frames 3 and 4 by means of curvilinear support element 14 defined on its top portion as having the same configuration as the trough 13 and on the side portions and bottom portions being angulated to complimentally nest and be fastened to the frames 3 and 4, this trough serves to support an additional pole 24 prior to its disposition in the shrouded area 25 for deployment, or conversely can store the pole 24 after deployment when a series of covers are to be conveyed and the protection of the area to be covered with the cover provides a time constraint when deployment or retraction of the cover in as expeditious manner is of paramount importance.

Having thus described the invention it will be apparent that numerous structural modifications are contemplated as being a part of this invention as set forth hereinabove and as defined by the claims.

What is claimed is:

1. A dolly comprising a substantially rectangular lower frame member having a tapered front portion, an axle rearwardly disposed on said frame to carry two wheels, a pair of inverted U-shaped frame members which are connected to said lower frame member and provide a support structure for upper frame members, a housing nested on an upper portion of said upper frame members, a pair of rollers disposed within said housing on a roller carriage, a cover carrying pole overlying said rollers, and a shroud overlying said pole to provide a latched safety catch and to prevent the cover carrying pole from being dislodged from the roller carriage, a flexible rear suspension means for dissipating shock loads throughout the frame members, said rear suspension means includes a resilient tie bar connecting each inverted U-shaped frame member to said lower frame member through a sleeve on the inverted frame, U-shaped frame member and lower frame and a pivot carried at each extremity of said resilient tie bar, and a handle means disposed at both extremities of said cover carrying pole defined by a flanged end of said cover carrying pole fastened to an elongate crank handle member substantially medially along said handle member's elongate extent and lock handle means releasably fastening said flange to said elongate crank handle member used when paying out the cover, and a front wheel disposed at the bottom of and in the front of said lower frame member.

2. The device of claim 1 further including a trough disposed on the front portion of said lower frame to provide a supplemental nesting area for a second cover carrying pole.

3. The device of claim 2 in which said cover carrying pole is removeable.

4. The device of claim 3 in which an eye bolt is deployed along the front portion of said lower frame member to accommodate a tow handle element for pulling said dolly and said eye bolt is vertically upstanding and planar with said front wheel and said tow handle element has a hooked end for releaseably engaging said eye bolt.

5. The device of claim 4 in which said upper frame members include a first pair of block elements transversely disposed on and connecting said pair of inverted U-shaped frame members forming part of said roller carriage, a supporting rod connecting said first pair of block elements substantially medially of said pair of inverted U-shaped frame members, and a second pair of block elements connected to said supporting rod parallel to said first pair of block elements fastened to a bottom face of said housing whereby rocking of said housing due to uneven terrain transmitted through said cover carrying pole will be absorbed at said supporting rod.

* * * * *